US005150818A

United States Patent [19]

DeMoss

[11] Patent Number: 5,150,818

[45] Date of Patent: Sep. 29, 1992

[54] LITERATURE DISPENSING APPARATUS

[76] Inventor: Paul S. DeMoss, 2921 Lenox Rd. NE., No. 214, Atlanta, Ga. 30324

[21] Appl. No.: 649,698

[22] Filed: Feb. 1, 1991

[51] Int. Cl.[5] ..... B65H 1/08

[52] U.S. Cl. ..... 221/228; 221/231; 221/255; 221/277

[58] Field of Search ..... 221/231, 255, 277, 228; 271/34, 37

[56] References Cited

U.S. PATENT DOCUMENTS

| | | | |
|---|---|---|---|
| 927,655 | 7/1909 | Jung | 221/228 |
| 1,918,460 | 7/1933 | Eccardt | 221/231 |
| 3,894,732 | 7/1975 | Müller | 271/34 |

FOREIGN PATENT DOCUMENTS

| | | | |
|---|---|---|---|
| 100106 | 11/1898 | Fed. Rep. of Germany | 221/231 |
| 0075093 | 3/1990 | Japan | 221/231 |

*Primary Examiner*—H. Grant Skaggs
*Attorney, Agent, or Firm*—Roger A. Marrs

[57] ABSTRACT

A display apparatus is disclosed herein for storing a quantity of literature sheets or brochures in an ordered stack so that the uppermost piece of literature is visually displayed. Means are provided for advancing the stack of literature within a housing so that the uppermost piece of literature bears against an advanacement mechanism including rollers which advances the uppermost piece of literature so as to be partially exposed externally of a dispensing slot so that a user may readily grasp the exposed portion and withdraw the literature. The stack of literature is carried on a spring-biased platform normally urging the stack upward against the underside of the advancement mechanism. A guide system maintains the platform in a centered disposition with respect to the storage housing.

3 Claims, 3 Drawing Sheets

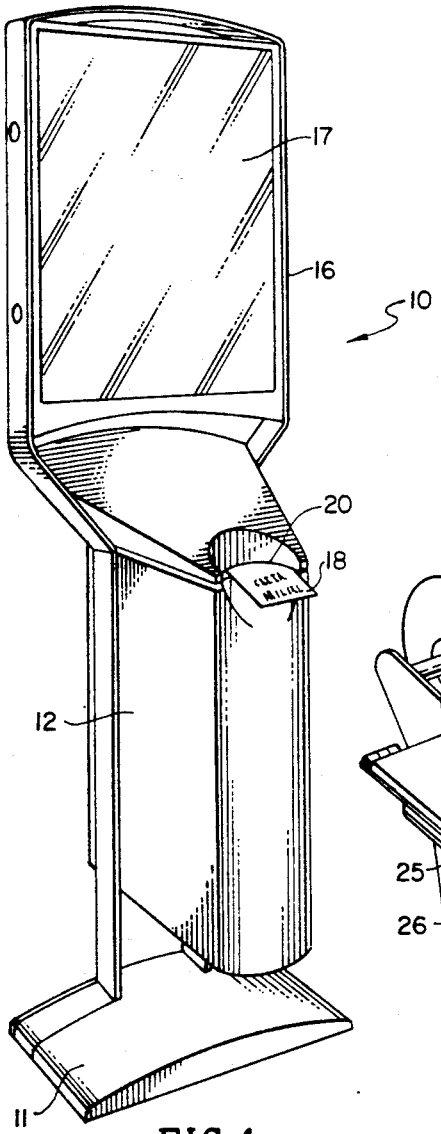
FIG. 1.
FIG. 2.
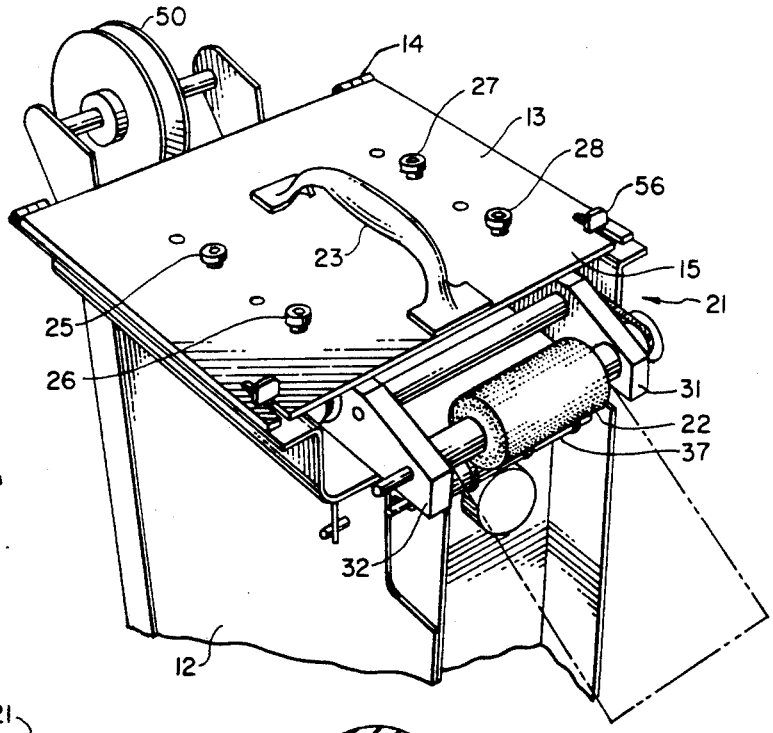
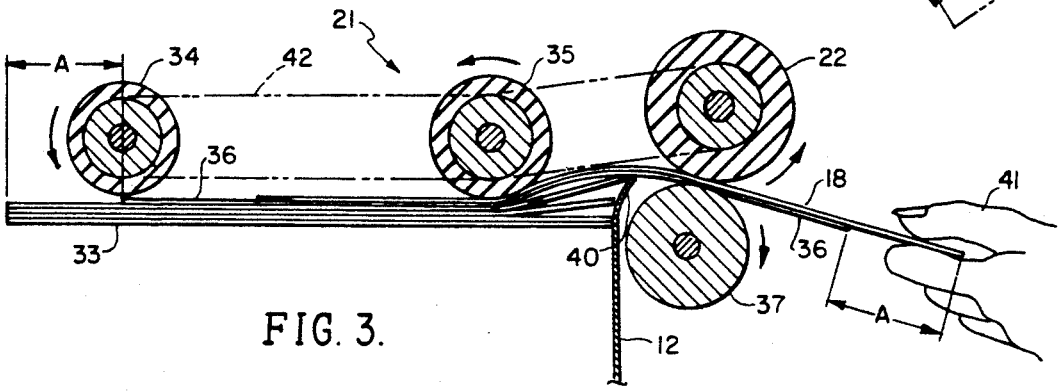
FIG. 3.

LITERATURE DISPENSING APPARATUS

BACKGROUND OF THE INVENTION

1. Field of the Invention

The present invention relates to the field of literature display and dispensing means, and more particularly, to a novel combined display and dispensing apparatus having a storage compartment for holding a quantity of pieces of literature and which includes means for forcibly urging the stack upward so that the topmost piece of literature is available for viewing and exposing a portion of the literature for dispensement through a slot in the housing by automatic advancement mechanism.

2. Brief Description of the Prior Art

In the past, it has been the conventional practive to distribute literature, such as brochures or information sheets, by placing them in a stack held in a rack, basket or the like. In some instances, wire or plastic racks are employed so that the outside or topmost piece of literature in the stack is available for perusal by potential customers or the like. Should the consumer or interested party desire the literature, the uppermost or outermost piece is lifted from the stack and manually separated from the holder or rack on which the stack is held.

Furthermore, most storage means for the stack of literature hold less than four inches of literature (thus, a problem to keep full) and if the holding means holds more, such as in a large stand, the potential customer must bend over as the stack is depleted in order to manually take a piece of the literature.

Further difficulties and problems are encountered with such conventional holding means for a stack of literature, which stem largely from the fact that the stack is not protected from dirt, gum, trash or other foreign matter which may collect and distort the view of the literature as it is being perused by a potential or interested customer. Often, more than one piece is taken by mistake as when the customer takes one piece, friction between adjacent literature piece faces often causes another piece to leave the stack and thus causes unnecessary waste, or frequently it is difficult for the customer to separate one piece of literature with his or her fingers. Other problems occur since the stack of literature may not be completely balanced, so that a tendency to topple or become completely separated oftentimes occurs. Lack of balance in conventional literature racks also frequently causes literature to become bent, curled and/or otherwise damaged and unsightly.

Therefore, a long-standing need has existed to provide a novel dispenser for holding a large stack of pieces of literature so that the uppermost piece is available for perusal and at the same time the rest of the stack is completely covered, so that dirt and other foreign matter cannot penetrate the stack or obliterate the literature. Thus, is it desirable to have a storage and dispensing means for literature which comprises a combination of an advertising area and literature dispensing apparatus. The ability to hold, protect and dispense a wide range of literature sizes and weights is also of importance in the same display-dispenser apparatus.

SUMMARY OF THE INVENTION

Accordingly, the above problems and difficulties are obviated by the present invention which provides a novel literature display-dispensing apparatus for displaying, releasing and permitting the withdrawal of a single piece of literature supported by a stack of literature whereby a storage compartment is provided in a housing that mounts a movable platform supporting the stack of literature pieces. Resilient means are operatively connected between the stationary housing and the movable platform for normally biasing the literature stack in an upward direction so that the uppermost piece of literature is available through a display means for perusal by an intended customer or user. Access to the storage compartment is via a hinged lid or cover. A feature of the invention resides in the fact that an advancement mechanism is provided beneath the lid and cooperates with the uppermost piece of literature to effect dispensing. Also, display means can be provided for a static display of a poster or other graphic material displaying indicia which may relate to the literature pieces being dispensed.

Therefore, it is among the primary objects of the present invention to provide a novel literature display and dispensing apparatus for holding a quantity of literature in a stack whereby the uppermost piece of literature in the stack may be view externally of the apparatus and can be easily removed by the user when desired to be separated from the stack.

Another object of the present invention is to provide a novel dispensing apparatus for holding and storing a stack of literature having resilient biasing means for introducing the uppermost sheet of literature in the stack for dispensing through a slot after viewing the partially exposed piece of literature.

Another object of the present invention is to provide a novel means for holding a plurality of literature pieces in such a fashion that a single piece from the plurality may be dispensed from the apparatus at an angle and height which is convenient to the user.

A further object of the present invention is to provide an inexpensive and reasonably simple means of storing a plurality of literature pieces so that a single piece may be extracted or dispensed without disturbing the remaining pieces in the stack or plurality.

Yet another object of the present invention is to provide a novel combined display and literature dispensing apparatus which may include a static display of a poster or other graphic material in combination with dispensing of the topmost piece of literature from a stack.

A further object relates to a combined dispensing and display apparatus for literature, having the ability to hold, protect and dispense a high volume of literature pieces in a single storage unit and further having the ability for automatically advancing the uppermost piece of literature to a preparatory position, having a portion exposed so as to be readily available for grasping by the user when it is desired to extract the literature from the apparatus.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the combined display and dispensing apparatus of the present invention;

FIG. 2 is an enlarged front perspective view showing the housing and the hinging lid which mounts the automatic dispensing mechanism of the present invention as used in the embodiment shown in FIG. 1;

FIG. 3 is an enlarged diagrammatic view of the literature advancement mechanism shown in FIG. 2;

DESCRIPTION OF THE PREFERRED EMBODIMENT

Figure 4:
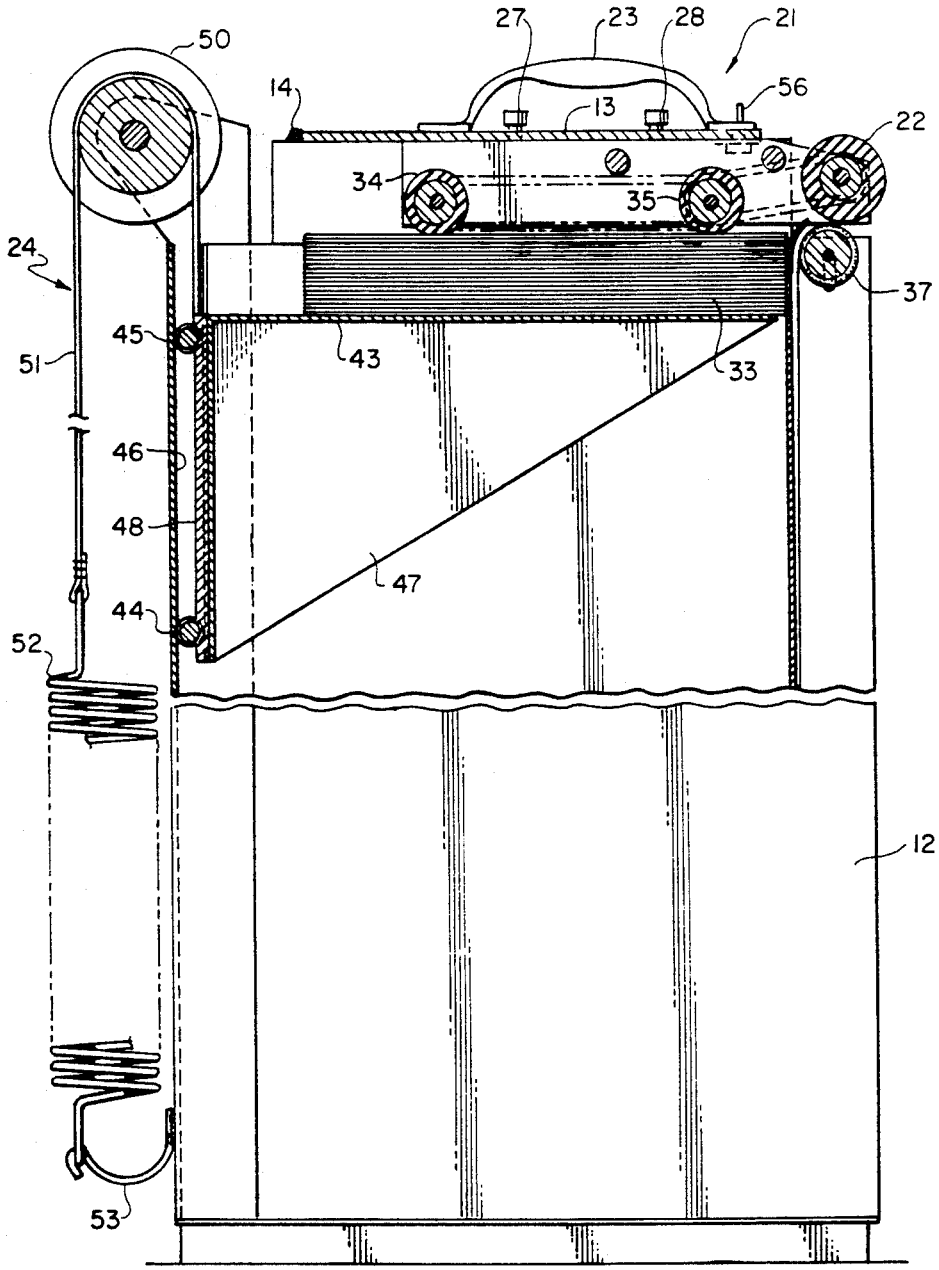
FIG. 4 is a cross-sectional view showing the resilient means for advancing the platform supporting a plurality of literature pieces and further illustrating the automatic uppermost sheet advancement mechanism.

Referring to FIGS. 1 and 2, the novel display stand of the present invention is illustrated in the general direction of arrow 10 which includes a support base 11 having an upright housing 12 defining an interior storage compartment and which terminates at its upper end with a pivoting lid or cover 13. The back side of the lid 13 is hinged to the housing by means of a support hinge 14. The lid may be simply raised by manually lifting the end 15 of the lid so that the lid will pivot about the hinge 14.

It is to be particularly noted that the housing includes a display means or frame 16 having a central window composed of transparent material and indicated by numeral 17. A poster or other graphic material may be held in static display by the frame. An uppermost piece of literature is indicated by numeral 18 which is the topmost piece of literature on a stack within the storage compartment of the housing 12. Only an end portion of the uppermost literature piece 18 is exposed so that removal can be manually made by pulling the piece out through a dispensing slot 20.

An important feature of the invention resides in the provision that an advancement mechanism 21, shown in FIG. 3, is at a dispensing angle with respect to the longitudinal axis of the elongated housing or cabinet 12. Such an angular disposal of literature permits easier viewing of the literature as it extends outwardly from the dispensing slot, and is the most natural ergonomic angle for the consumer to withdraw a piece of literature.

The lid 13 is held in releasable position by a latch 56 and a handle 23 may be used manually to raise the lid. A resilient means 24 is employed for biasing the stack of literature upwardly against the underside of the advancement mechanism 21. The mechanism 21 is carried in a downwardly depending position from the lid 13 by mounting screws 25, 26, 27 and 28. The screws fasten with advancement mechanism side members 31 and 32 which project ahead of the lid 13 terminating in support for dispensing roller 22.

Referring now to FIG. 3, a diagrammatic view is presented showing the advancement mechanism for permitting the dispensing of the topmost piece of literature 18 from the stack of literature held within the container 12. The stack is indicated by numeral 33. The advancement mechanism includes a pair of counterclockwise rotating rollers 34 and 35, having cushioned peripheries in engaging contact with at least the uppermost two pieces of literature. Roller 35 engages with literature piece 18 while roller 34 engages with the under sheet identified by numeral 36. Roller 22 is raised so that its axis of rotation is slightly higher than the turning axis of rollers 34 and 35 and the periphery of roller 22 engages with the uppermost sheet 18. A support roller 37 is carried on the storage cabinet 12 and rotates in an opposite direction from the counterclockwise rotation of roller 22. The roller 37 is spring-loaded so as to make constant contact with the upper roller or the underside of the sheets 18 or 36. The springloading of roller 37 also allows for different thicknesses of literature to pass between the rollers and ensures that traction occurs between literature 18 and roller 22. A feature of the invention resides in providing an adjustable sorting flange or lip 40 against which pieces of literature immediately beneath the first and second sheets in the stack will abut. However, as the first or second sheet in the stack is withdrawn in successive order, the leading edge of the literature sheets will advance over the outward curvature of the lip into a preparatory position for removal from the mechanism. The three rollers, 34, 35 and 22, are geared together on a one to one ratio and the spring mechanism 24 advances the stack of literature in a feeding procedure towards the rollers 34 and 35. In this manner, the stack of literature is always ready to be fed and dispensed from the apparatus one piece at a time. Approximately 2½ inches of the topmost piece of literature is available for pullout by the consumer's fingers which are indicated by numeral 41. The pulling of the topmost piece of literature from between the rollers 22 and 37 advances the second or next piece of literature 36 for the taking. It is the frictional relationship between the opposing surfaces of the piece of literature 18 and piece of literature 36, and rollers 35 and 34, which achieves the advancement over the sorting fence or lip 40. Thus, one piece of literature is taken at a time. An activating belt 42 operably connects the rollers together so that as the uppermost piece of literature is withdrawn, causing the rollers to rotate, this movement is transferred to other rollers so as to advance the undermost piece of literature after the topmost has been removed.

Referring now in detail to FIG. 4, it can be seen that the stack of literature 33 is supported on a platform 43 which is movably disposed within the storage chamber or cabinet 12 by means of support rollers 44 and 45 which ride on the inner surface of the cabinet as indicated by numeral 46. The platform 42 is supported by a gusset 47 attached between the underside of the platform 43 and a carriage 48 which supports the rollers 44 and 45. The resilient means 24 biases the platform 43 and the stack of literature 33 upwardly into engagement with the underside of the advancement mechanism 21. The resilient means includes a pulley 50 operably attached to the cabinet 12 so that a cable 51 having one end attached to the carriage 48 will draw the platform upwardly in response to the compression of a spring 52. One end of the spring is attached to the end of cable 51 while the other end is fixedly attached by means of a hook 53 to the cabinet 12. Therefore, it can be seen that as the tension of spring 52 contracts, the cable 51 exerts a force on carriage 48 that causes the carriage to move upwardly carrying the platform 43 and the stack of literature 33 into contact with rollers 34 and 35. The spring rate of spring 52 is arranged to match the weight of literature 33 so that compensation is achieved for the diminishing stack of literature.

Figure 5:
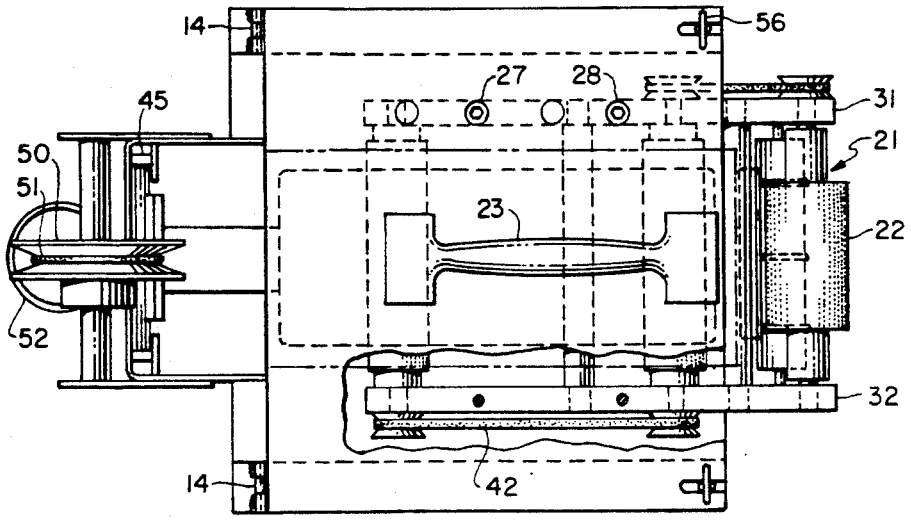
FIG. 5 is a top plan view of the cover and advancement mechanism as well as the resilient means shown in FIG. 4.
Figure 7:
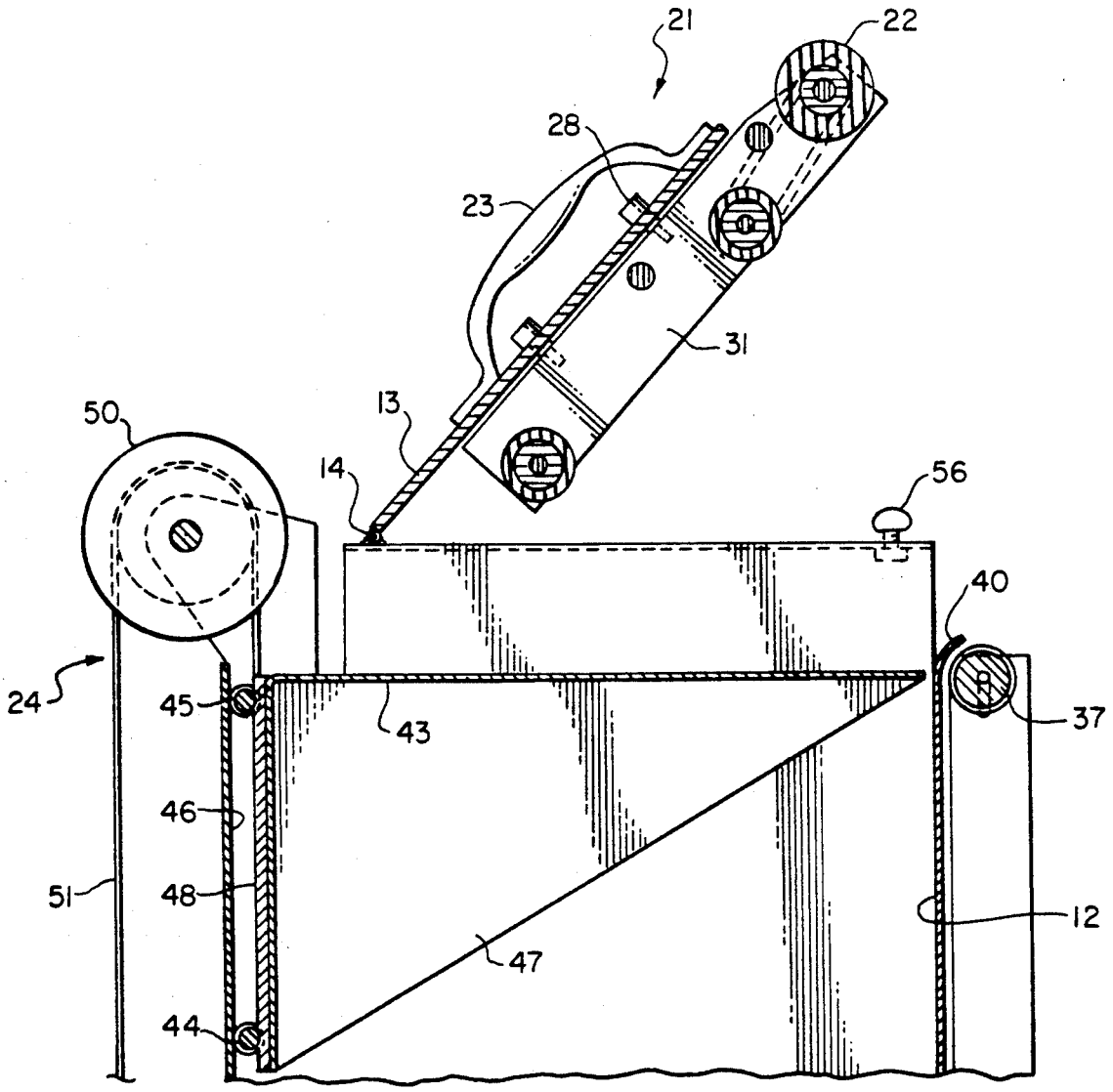
FIG. 7 is a view similar to the view of FIGS. 2 and 3 showing the lid in a raised position, permitting access to the storage compartment in the housing.
Figure 6:
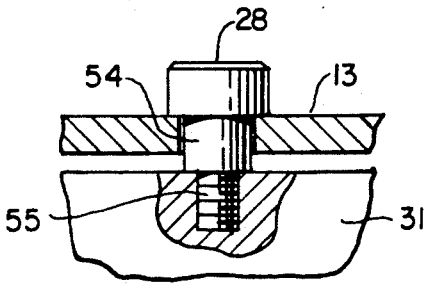
FIG. 6 is an enlarged fragmentary view, in section, of the cover for the storage apparatus.

Referring now in detail to FIGS. 5 and 7, it can be seen that the advancement mechanism 21 may be raised so as to gain access to platform 43 whereby the stack of literature may be placed on top and the platform can be moved downwardly followed by closing of the advancement mechanism over the loaded storage compartment. FIG. 7 also shows that the advancement mechanism is carried under the lid 13 by means of side members 31 and 32 being attached to the lid by fasteners, such as fastener 28. FIG. 6 is an enlarged view of the fastener, showing that the fastener includes a smooth shank 54 passing through a hole in the lid and which further terminates in a threaded portion 55 that is in threaded engagement with a threaded bore in the side member 31. By employing the cylindrical smooth shank 54, a limited amount of play is permitted the lid 13 between the underside of the head 28 and the upper surface of the side members 31 and 32 which will accommodate for any misalignment of literature in a horizontal plane immediately beneath the advancement mechanism. Such misalignment may occur due to biasing of the literature stack towards one side or sides, which is caused by many types of folded literature, improper placement of the stack within the storage compartment on platform 43 or the like.

It is also to be noted in FIGS. 2 and 7 that the lid 13 is held in the down position with the rollers in contact with the uppermost piece of literature by a twist latch, indicated by numeral 56. When the latch is released or twisted so that its flanged head accommodates passage of a slot in the lid, the lid can then be pivoted upwardly by means of the hinge arrangement 14.

Therefore, it can be seen that the literature dispensing apparatus of the present invention provides a storage container for movably mounting a platform holding a plurality of pieces of literature in a stack 33. The uppermost piece of literature is slightly exposed beyond the rollers 22 and 37, offering a portion which is grasped by the fingers 41 of the user. As the user pulls the uppermost piece of literature from the apparatus, the rollers 22, 35 and 34 are rotated via the belt 42 and the peripheral frictional surface of each roller 34 and 35 will grasp the underlying or second piece of literature from the top in the stack and advance it to a position to be grasped by another user. The friction between the sheets is overcome by the force of the rollers as the user pulls the uppermost sheet from the apparatus. As sheets of literature are dispensed from the stack, the platform 43 is advanced upwardly towards the advancement mechanism 21 by means of the resilient spring arrangement 24.

Additionally, the advertising message, such as a poster which is carried in the frame 16, is visible through the window 17. The information or graphic subject matter shown on the poster or material carried on the frame can be correlated with the information carried on the piece of literature which is exposed through the dispensing slot 20. If desired, the base 11 may be placed on wheels or casters, or bolted to the floor. Also, the apparatus may be placed in tandem in back-to-back relationship.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A stand for display of advertising messages and dispensing of pieces of literature from a stack comprising the combination of:

an elongated upright cabinet having an internal storage compartment;

a movable carriage positionable within said storage compartment, in a vertical reciprocal and rectilinear direction so as to move a platform fixed on said carriage within said storage compartment in said vertical direction;

roller means carried on said carriage rollably engaging with an opposing wall surface of said cabinet while permitting stabilized carriage travel through said cabinet storage compartment in said vertical direction;

a stack of literature pieces disposed on said platform having the topmost piece of literature partially exposed in a preparatory position for removal from said cabinet;

a lid movably attached to said cabinet for opening and closing said storage compartment;

resilient means operably coupled between said carriage and said cabinet exteriorly of said cabinet normally biasing and urging said stack of literature pieces in a vertical rectilinear direction towards said lid;

advancement mechanism carried on the underside of said lid in frictional engagement with the uppermost piece of literature whereby manual advancement of said topmost piece of literature from said cabinet moves a secondmost piece of literature underlying said topmost piece into said preparatory position;

means movably mounting said advancement mechanism on said lid to accommodate for misalignment of said literature in a horizontal plane immediately beneath said advancement mechanism;

said cabinet having a dispensing slot immediately ahead of said advancement mechanism through which a portion of said topmost piece of literature is exposed when in said preparatory position; and said resilient means comprising at least one coil spring having opposite ends connected to said cabinet and said carriage respectively.

2. The invention as defined in claim 1 wherein:

said advancement mechanism includes a pair of rollers carried on said lid having turning axis lying on the same horizontal plane and peripheral surfaces rollably engaging with said topmost and said secondmost pieces of literature respectively in said stack.

3. The invention as defined in claim 2 wherein:

said advancement mechanism further includes a dispensing roller carried on said lid ahead of said pair of rollers adjacent said dispensing slot having a turning axis offset from said horizontal plane of said pair of roller turning axis rollable in response to withdrawal of said topmost piece of literature; and means movably coupling said dispensing roller to said pair of rollers for rotating said pair of rollers during withdrawal of said topmost piece of literature.

* * * * *